US007799708B2

(12) United States Patent
Francis et al.

(10) Patent No.: US 7,799,708 B2
(45) Date of Patent: Sep. 21, 2010

(54) COATED FABRICS WITH INCREASED ABRASION RESISTANCE

(75) Inventors: Robert T. Francis, Pace, FL (US); Albert E. Ortega, Pensacola, FL (US)

(73) Assignee: Cerex Advanced Fabrics, Inc., Cantonment, FL (US)

( * ) Notice: Subject to any disclaimer, the term of this patent is extended or adjusted under 35 U.S.C. 154(b) by 892 days.

(21) Appl. No.: 11/705,892

(22) Filed: Feb. 12, 2007

(65) Prior Publication Data

US 2007/0207686 A1 Sep. 6, 2007

Related U.S. Application Data

(60) Provisional application No. 60/772,383, filed on Feb. 10, 2006.

(51) Int. Cl.
*B32B 5/18* (2006.01)

(52) U.S. Cl. ..... 442/76; 280/728.1

(58) Field of Classification Search ..... 442/76, 442/157, 351, 401

See application file for complete search history.

(56) References Cited

U.S. PATENT DOCUMENTS

| | | | |
|---|---|---|---|
| 3,692,618 | A | 9/1972 | Dorschner et al. |
| 3,802,817 | A | 4/1974 | Matsuki et al. |
| 3,968,307 | A | 7/1976 | Matsui et al. |
| 4,009,315 | A | 2/1977 | Healy et al. |
| 4,052,146 | A | 10/1977 | Sternberg |
| 4,168,195 | A | 9/1979 | Anderson et al. |
| 4,340,563 | A | 7/1982 | Appel et al. |
| 4,406,850 | A | 9/1983 | Hills |
| 4,424,257 | A | 1/1984 | Bach |
| 4,424,258 | A | 1/1984 | Bach |
| 4,547,423 | A | 10/1985 | Kojima et al. |
| 4,830,904 | A | 5/1989 | Gessner et al. |
| 5,004,643 | A | 4/1991 | Caldwell |
| 5,411,795 | A | 5/1995 | Silverman |
| 5,431,986 | A | 7/1995 | Ortega et al. |
| 5,534,339 | A | 7/1996 | Stokes |
| 5,589,258 | A | 12/1996 | Maddern et al. |
| 5,783,503 | A | 7/1998 | Gillespie et al. |
| 5,895,710 | A | 4/1999 | Sasse et al. |
| 5,913,993 | A | 6/1999 | Ortega et al. |
| 6,074,590 | A | 6/2000 | Gownder |
| 6,207,276 | B1 | 3/2001 | Spindler et al. |
| 6,566,287 | B1 | 5/2003 | Mimura et al. |
| 6,645,225 | B1 | 11/2003 | Atkinson |
| 7,148,160 | B2 | 12/2006 | Porter |

FOREIGN PATENT DOCUMENTS

| | | | |
|---|---|---|---|
| JP | 10 226963 | A | 8/1998 |

OTHER PUBLICATIONS

Database WPI Week, Accession No. 1998-515299, Ishikawa, K., et al., "Net used for construction and civil engineering—consisting of synthetic fibre coated and bundled with synthetic resin," Aug. 26, 1998, XP-002584915.

*Primary Examiner*—Arti Singh-Pandey
(74) *Attorney, Agent, or Firm*—Saliwanchik, Lloyd & Saliwanchik

(57) ABSTRACT

A silicone coating is applied to fabrics to increase the abrasion resistance while enhancing the natural absorbency and breathability. These fabrics can be used for a variety of applications such as components for shoes, inkjet receptive media, automotive air bags, facing for insulation, tapes and other uses.

23 Claims, No Drawings

COATED FABRICS WITH INCREASED ABRASION RESISTANCE

CROSS-REFERENCE TO A RELATED APPLICATION

This application claims the benefit of U.S. Provisional Application Ser. No. 60/772,383, filed Feb. 10, 2006.

FIELD OF THE INVENTION

This invention relates to coated fabrics with increased abrasion resistance and enhanced absorbency and breathability. The structure of the fabric along with the coating increases the abrasion resistance.

BACKGROUND OF THE INVENTION

Fabrics have been coated in the past for uses in applications such as components for shoes, inkjet receptive media, automotive air bags, facing for insulation, tapes and other uses. Abrasion resistance requirements exist for some of these applications. Specifically, in the shoe component applications, the test method SATRA 31A is used to measure abrasion resistance. Spunbond fabrics without coatings fail the abrasion resistance requirements for use as a component in shoes.

Fabrics currently used in these applications are produced in multiple manufacturing which are costly. A less expensive alternative that provides enhanced abrasion resistance would be of benefit.

Similarly, coated fabrics are used in other applications such as automotive air bags. These fabrics are typically woven nylon fabrics with silicone coatings and are very expensive. A less expensive alternative would also be of benefit in this application.

BRIEF SUMMARY OF THE INVENTION

The subject invention provides fabrics that have a denier per filament of 3.5 or less and are coated to provide enhanced abrasion resistance. In an embodiment specifically exemplified herein, the fabric is a spunbonded nylon fabric made with two denier per filament (dpf) and around a 17.5% or higher bond area. Preferably, a silicone coating is applied to the fabric. In another preferred embodiment, a 3-dpf spunbonded nylon fabric can be coated with the silicone coating.

In a preferred embodiment, the coating is an elastomeric silicone macro-emulsion.

Spunbond processes typically use one or more extruders to melt polymer resins. Polymers such as polyesters, polyamides, polyimides, polypropelene, polyethylene, polystyrene, TEFLON®, fiberglass, polytrimethylene, polylactic acid, polycarbonates, polyester terephthalate or polybutylene terephthalate can be used. Also, mixtures, blends or copolymers can be used as taught in U.S. Pat. Nos. 5,431,986 and 5,913,993 both incorporated herein by reference.

Various filament cross sections such as round, trilobal, multilobal, crescent, cross or X, E or oval shapes or hollow filaments can be used. The melt stream is then filtered and pumped to a spinneret forming filaments that are typically quenched with cool air.

Bicomponent or multicomponent spinning methods as described in U.S. Pat. Nos. 3,968,307; 4,052,146; 4,406,850; 4,424,257; 4,424,258; 4,830,904; 5,534,339; 5,783,503; 5,895,710; 6,074,590 and 6,207,276, incorporated by reference, can also be used to make multiconstituent filaments with various properties.

The filaments can be attenuated and drawn pneumatically through a jet or slot device and deposited onto a collection surface to form a web. Air is commonly used as the attenuation medium. A vacuum can also be used to move the air through the attenuation device. The web is then bonded together to produce a strong, coherent fabric. Filament bonding is typically accomplished either thermally or chemically, i.e., autogenously. Thermal bonding is accomplished by compression of the web of filaments between the nips of a pair of cooperating heating calender rolls.

The web is then calendered at, for example, 215 C engraved roll temperature and 205 C smooth roll temperature.

In autogenous bonding of nylon filaments, the web of filaments is transported to a chemical bonding station or "gashouse" that exposes the filaments to an activating agent (i.e., HCl) and water vapor. Water vapor enhances the penetration of the HCl into the filaments and causes them to become tacky and thus amenable to bonding. The web may also be bonded using adhesives to "glue" fibers together to render the fibers cohesive.

Upon leaving the bonding station, the web passes between rolls, which compress and bond the web.

Even distribution of mass is preferred to provide minimal variation in fabric physical properties and to impart uniformly, good strength properties to the fabric. These fabrics can then be coated to increase the abrasion resistance while maintaining their natural absorbency and breathability.

DETAILED DISCLOSURE OF THE INVENTION

In the following detailed description of the subject invention and its preferred embodiments, specific terms are used in describing the invention; however, these are used in a descriptive sense only and not for the purpose of limitation. It will be apparent to the skilled artisan having the benefit of the instant disclosure that the invention is susceptible to numerous variations and modifications within its spirit and scope.

This invention concerns the coating of fabric made with a denier per filament (dpf) of 3.5 or less to enhance the abrasion resistance while maintaining the breathability of the resulting coated fabric. The coated fabric also has enhanced absorbency.

The subject invention provides fabrics that have a denier per filament of 3.5 or less and are coated to provide enhanced abrasion resistance. In an embodiment specifically exemplified herein, the fabric is a spunbonded nylon fabric made with two denier per filament (dpf) and around a 17.5% or higher bond area. Preferably, a silicone coating is applied to the fabric. In another preferred embodiment, a 3-dpf spunbonded nylon fabric can be coated with the silicone coating.

Silicones (more accurately called polymerized siloxanes or polysiloxanes) are inorganic-organic polymers with the chemical formula $[R_2SiO]_n$, where R=organic groups such as methyl, ethyl, and phenyl. These materials consist of an inorganic silicon-oxygen backbone ( . . . —Si—O—Si—O—Si—O— . . . ) with organic side groups attached to the silicon atoms, which are four-coordinate. In some cases organic side groups can be used to link two or more of these —Si—O— backbones together. In a preferred embodiment, the coating used according to the subject invention is an elastomeric silicone macro-emulsion.

The fabrics of the subject invention can be used for a variety of applications including, but not limited to, components for shoes, inkjet receptive media, automotive air bags, facing for insulation, tapes and other uses.

The breathability of the fabric treated in accordance with the subject invention is at least 25% of the breathability for the untreated fabric, preferably at least 50% of that of the untreated fabric, and most preferably 75% or more of that for the untreated fabric.

In one embodiment, a two dpf, 100 gram per square meter thermal bonded fabric was coated. Testing of this fabric demonstrates improved abrasion resistance as measured by the SATRA 31A test method. In a preferred embodiment, the abrasion resistance was 51,200 revolutions as measured by the Dry Martindale test and 12,800 as measured by the wet Martindale test.

In another embodiment, polyester can be used to make a three dpf, 100 gram per square meter fabric. This fabric can then be coated to improve the abrasion resistance. In other embodiments, polyethylene, polypropylene, and/or polyester can be added to the nylon material to produce a blend. This produces a softer feel and increases water repellency in the base fabric. In the case of polyethylene, the polyethylene should have a melt index between about 5 grams/10 min and about 200 grams/10 min and a density between about 0.85 grams/cc and about 1.1 grams/cc. The polyethylene can be added at a concentration of about 0.05% to about 20%. This fabric made from a blend of polymers can then be coated to improve abrasion resistance.

The silicone coating used according to the present invention can be an elastomeric silicone micro-emulsion obtainable from, for example, Wacker, Inc. (CRX-150). The silicone can also be obtained from, for example, Dow Corning or Rhodia and is a silicone appropriate to fiber coating such that the coating results in a fabric that is "breathable" (air permeability). Those skilled in the art, having the benefit of the current disclosure, could choose a silicone and application method from those set forth in, for example, U.S. Pat. No. 6,645,225, and the patents recited therein, all of which are specifically incorporated herein by reference, in their entirety.

Metal coatings such as those described in U.S. Pat. No. 5,411,795 and its references, all incorporated by reference, can be applied to a fabric. The silicone coating can then be applied to these metal coated fabrics. Similar physical properties as in the fabrics with just the silicone coating would be expected in addition to those properties imparted by coating the fabrics with various metals.

Fabrics can be printed or dyed and then coated with a silicone coating composition. The coating of the subject invention can include other ingredients such as, for example, antimicrobials, fungicides, and fire retardants.

A multicomponent fabric can be used according to the present invention. Such a fabric could have filaments made up of two or more polymers. Polymers such as polyesters, polyamides, polyimides, polypropylene, polyethylene, polystyrene, TEFLON®, fiberglass, polybutylene terephthalate, polytrimethylene, polylactic acid, polycarbonates, polyester terephthalate or polybutylene terephthalate can be used. In a specific embodiment a nylon sheath can be used with a less expensive polymer in the core to reduce cost associated with the original fabric. The uncoated fabrics can then be treated and coated with a silicone coating.

The fabric used according to the subject invention can have filaments with cross sections that are round, trilobal, multilobal, crescent, cross or X, E or oval shaped. The filaments can also have any other cross section that can be manufactured. Hollow filaments can also be used.

In one embodiment, the fabric used can be an autogenously bonded nylon spunbonded fabric as described in U.S. Pat. No. 4,168,195 to Anderson et al., incorporated herein by reference.

In another embodiment, the fabric used can be a nonwoven fabric. The filaments of the nonwoven fabric can be made from polymers, such as polyesters, polyamides, polyimides, polypropylene, polyethylene, polystyrene, TEFLON®, fiberglass, polybutylene terephthalate, polytrimethylene, polylactic acid, polycarbonates, polyester terephthalate, polybutylene terephthalate, acrylic, or polyvinyl alcohol polymers, or a combination of these polymers.

In another embodiment, the fabric used can be a nonwoven spunbond nylon fabric. The fabric can be made from nylon 6; nylon 6,6; nylon 11; nylon 12; or a combination or copolymer of these nylons.

It should be understood that the examples and embodiments described herein are for illustrative purposes only and that various modifications or changes in light thereof will be suggested to persons skilled in the art and are to be included within the spirit and purview of this application and the scope of the appended claims.

EXAMPLE 1

A two dpf, 100 gram per square meter spunbonded nylon web was produced and thermally bonded. A slot draw process was used. A jet attenuation system can also be used to achieve a fabric with a two dpf. This fabric was then coated with an elastomeric silicone macro-emulsion (CRX-150) obtainable from Wacker, Inc. The fabric passed the abrasion resistance tests as measured by the dry Martindale test at 51,200 revolutions and the wet Martindale test at 12,800 revolutions. The abrasion resistance of the uncoated fabrics was much worse as they did not pass these tests. The air permeability as measured by ASTM test method D737 was 81.3 CFM/square foot and 82.3 CFM/square foot for a similar uncoated fabric sample.

Table 1 lists the physical properties of the uncoated and coated fabric.

TABLE 1

Physical properties for uncoated and coated 100 gsm nylon spunbonded fabrics.

| Property | Units | Test Method | Uncoated | Coated Fabric |
|---|---|---|---|---|
| Basis Weight | gsm | D3776 | 96 | 130 |
| Air Permeability | CFM/SF | D737 | 82.3 | 81.3 |
| Abrasion Resistance | | | | |
| Dry Martindale | Revs | SATRA 31A | n/a | 51,200 |
| Wet Martindale | Revs | SATRA 31A | n/a | 12,800 |
| Pilling Resistance | | | | |
| Rating (5 no pilling, 1 severe) | n/a | SATRA 31A | n/a | 5 |

The results show that the fabric with a dpf lower than three, i.e., two coated with the silicone material yields abrasion resistance that is acceptable to use as a component for shoes and maintains its breathability as demonstrated in the minimal change in air permeability.

EXAMPLE 2

The silicone material described in Example 1 can be applied to a thermally bonded, three or less dpf spunbond fabric produced using jet attenuators or a slot attenuation system, running nylon 6,6 polymer or a blend of nylon 6,6 and nylon 6 as described in U.S. Pat. No. 5,431,986. Similar results as described in Example 1 would be expected.

EXAMPLE 3

The silicone material described in Example 1 can be applied to a thermally bonded, three or less dpf spunbond fabric produced using jet attenuators or a slot attenuation system, running a bicomponent or multicomponent spinning process. Similar results as described in Example 1 would be expected.

EXAMPLE 4

The silicone material described in Example 1 can be applied to a thermally bonded, three or less dpf spunbond fabric produced using jet attenuators or a slot attenuation system, running polymers such as polyesters, polyamides, polyimides, polypropelene, polyethylene, polystyrene, TEFLON®, fiberglass, polytrimethylene, polylactic acid, polycarbonates, polyester terephthalate or polybutylene terephthalate. Similar results as described in Example 1 would be expected.

EXAMPLE 5

The silicone material described in Example 1 can be applied to a thermally bonded, three or less dpf spunbond fabric produced using jet attenuators or a slot attenuation system, running any of the polymer systems described in any of the previous examples. These fabrics could have filament cross sections such as round, trilobal, multilobal, crescent, cross or X, E or oval shapes or hollow filaments. Other cross sections not listed could also be employed. Similar results as described in Example 1 would be expected.

EXAMPLE 6

The silicone material described in Example 1 can be applied to an acid bonded, three or less dpf spunbond fabric produced using jet attenuators or a slot attenuation system, running a nylon polymer system or a bicomponenet nylon system where the nylon portion of the filament is on the surface and exposed to the acid medium used to bond the fabric. These fabrics could have filament cross sections such as round, trilobal, multilobal, crescent, cross or X, E or oval shapes or hollow filaments. Other cross sections not listed could also be employed. Similar results as described in Example 1 would be expected.

EXAMPLE 7

A four denier, 100 gram per square meter spunbonded nylon web was produced and coated with a silicone coating composition, CRX-150. The nylon web is commercially available from Cerex Advanced Fabrics, Inc. as Style 30300 under the trade name PBN-II®. This fabric is a spunbonded nylon fabric that is thermally bonded at about 18% bond area. The coating composition may be applied to the textile fabric substrates according to known techniques. These include spraying, gravure coating, bar coating, coating by knife-over-roller, coating by knife-over-air, padding and screen-printing.

EXAMPLE 8

A two denier, 100 gram per square meter spunbonded polyester web was produced and coated with CRX-150. The polyester web is commercially available from Mogul Non-wovens, Inc. under the trade name MOPET®.

The coating composition may be applied to the textile fabric substrates according to known techniques. The coating was applied using a pad coater running at about 45 feet per minute through a sixty foot oven. The curing temperature was about 325° F. with a dwell time of about 1.33 seconds.

This coated fabric passed the Martindale abrasion SATRA TM 31: Method A: 2003 test by displaying moderate wear and pilling. Physical properties for the coated and uncoated fabrics are shown in Table 2 below. The results of the SATRA 31A test showed a passing result. The number of revolutions of the test is for counter linings for the most demanding footwear applications, e.g., sports shoes, industrial footwear, school shoes and men's everyday footwear.

TABLE 2

Physical properties for uncoated and coated 100 gsm polyester spunbonded fabrics.

| Property | Units | Test Method | Uncoated | Coated Fabric |
|---|---|---|---|---|
| Thickness | mils | D5729 | 17.43 | 17.03 |
| Air Permeability | CFM/SF | D737 | 119 | 59.1 |
| Stiffness | Lbf | D4032 | n/a | 2.978 |
| Abrasion Resistance | | | | |
| Dry Martindale | Revs | SATRA 31A | n/a | 51,200 |
| Wet Martindale | Revs | SATRA 31A | n/a | 12,800 |

EXAMPLE 9

Example 1 was repeated with a slight modification to the silicone coating. A two denier, 100 gram per square meter spunbonded nylon web was produced and coated with a silicone coating composition, CRX-150. The coating composition may be applied to the textile fabric substrates according to known techniques.

The coating was again applied using a pad coater running at about 45 feet per minute through a sixty foot oven. The curing temperature was about 325° F. with a dwell time of about 1.33 seconds. The nylon web is available from Cerex Advanced Fabrics, Inc. as Style W8300 under the trade name SPECTRAMAX™. This fabric is a spunbonded nylon fabric that is thermally bonded at about 18% bond area. Typical slot draw thermal bond processes are described in U.S. Pat. No. 4,340,563 to Appel et al, U.S. Pat. No. 3,802,817 to Matsuki et al. and U.S. Pat. No. 3,692,618 to Durschner et al. incorporated herein by reference. Physical properties for the coated and uncoated fabrics are shown in Table 3 below.

U.S. Pat. No. 7,148,160 to Porter defines breathability as any fabric with water vapor transmission above 250 g/day-$m^2$. This fabric well exceeds that criteria and is considered breathable. The stiffness of the 100 gsm coated nylon spunbonded fabric is much lower than the 100 gsm coated polyester spunbonded fabric, 0.214 $Lb_f$ versus 2.978 $Lb_f$. This provides a lower noise level when the coated fabric is moved, folded or rubbed against and more comfort to an individual when the fabric is used as a shoeliner or in an apparel application where it is touching a part of the human body.

TABLE 3

Physical properties for uncoated and coated 100 gsm nylon spunbonded fabrics.

| Property | Units | Test Method | W8300 Uncoated | M3420 Coated Fabric |
|---|---|---|---|---|
| Basis Weight | gsm | D3776 | 102.7 | 141.7 |
| Thickness | mils | D5729 | 17.1 | 15.8 |
| Air Permeability | CFM/ft$^2$ | D737 | 72.3 | 22.5 |
| Burst Strength | Lb$_f$/in$^2$ | D3786 | 82.6 | 79.0 |
| Machine Direction Grab Strength | Lb$_f$ | D5034 | 109.0 | 91.6 |
| Cross Direction Grab Strength | Lb$_f$ | D5034 | 71.9 | 70.1 |
| Machine Direction Grab Elongation | % | D5034 | 89.9 | 75.7 |
| Cross Direction Grab Elongation | % | D5034 | 91.0 | 98.6 |
| Machine Direction Strip Strength | Lb$_f$ | D5035 | 52.8 | 40.3 |
| Cross Direction Strip Strength | Lb$_f$ | D5035 | 28.8 | 18.7 |
| Machine Direction Strip Elongation | % | D5035 | 98.7 | 74.4 |
| Cross Direction Strip Elongation | % | D5035 | 86.1 | 72.8 |
| Stiffness | Lb$_f$ | D4032 | 1.231 | 0.214 |
| Machine Direction Trap Tear Strength | Lb$_f$ | D5733 | 26.0 | 23.7 |
| Machine Direction Trap Tear Strength | Lb$_f$ | D5733 | 44.2 | 35.1 |
| Water Vapor transmission | g/day-m$^2$ | ASTM E96-05 | n/a | 604.8 |

EXAMPLE 10

Example 8 was repeated except that a two denier, 67 gram per square meter spunbonded nylon web was produced and coated with the silicone coating composition, CRX-150. The coating composition may be applied to the textile fabric substrates according to known techniques.

In these examples, the coating was applied using a pad coater running at about 45 feet per minute through a sixty foot oven, and the curing temperature was about 325° F. with a dwell time of about 1.33 seconds. The nylon web is available from Cerex Advanced Fabrics, Inc. as Style W8200 under the trade name SPECTRAMAX™. This fabric is a spunbonded nylon fabric that is thermally bonded at about 18% bond area.

Physical properties for the coated and uncoated fabrics are shown in Table 4 below. This fabric well exceeds the 250 g/day-m$^2$ water vapor transmission needed to be considered breathable. The uncoated fabric displayed a water vapor transmission of 751.2 g/day-m$^2$.

TABLE 4

Physical properties for uncoated and coated 100 gsm nylon spunbonded fabrics.

| Property | Units | Test Method | W8200 Uncoated | M3275 Coated Fabric |
|---|---|---|---|---|
| Basis Weight | Gsm | D3776 | 68.7 | 89 |
| Thickness | Mils | D5729 | 13.0 | 11.9 |
| Air Permeability | CFM/ft$^2$ | D737 | 137.3 | 58.3 |
| Burst Strength | Lb$_f$/in$^2$ | D3786 | 51.0 | 53.3 |
| Machine Direction Grab Strength | Lb$_f$ | D5034 | 71.0 | 57.0 |
| Cross Direction Grab Strength | Lb$_f$ | D5034 | 52.2 | 40.8 |

TABLE 4-continued

Physical properties for uncoated and coated 100 gsm nylon spunbonded fabrics.

| Property | Units | Test Method | W8200 Uncoated | M3275 Coated Fabric |
|---|---|---|---|---|
| Machine Direction Grab Elongation | % | D5034 | 80.0 | 61.3 |
| Cross Direction Grab Elongation | % | D5034 | 82.5 | 83.0 |
| Machine Direction Strip Strength | Lb$_f$ | D5035 | 18.7 | 27.5 |
| Cross Direction Strip Strength | Lb$_f$ | D5035 | 30.0 | 13.9 |
| Machine Direction Strip Elongation | % | D5035 | 84.7 | 66.4 |
| Cross Direction Strip Elongation | % | D5035 | 88.0 | 70.7 |
| Stiffness | Lb$_f$ | D4032 | 0.521 | 0.642 |
| Machine Direction Trap Tear Strength | Lb$_f$ | D5733 | 12.1 | 10.2 |
| Machine Direction Trap Tear Strength | Lb$_f$ | D5733 | 20.7 | 17.7 |
| Water Vapor transmission | g/day-m2 | ASTM E96-05 | 751.2 | 664.8 |

EXAMPLE 11

A two denier per filament, autogenously bonded nylon spunbonded fabric as described in U.S. Pat. No. 4,168,195 to Anderson et al., incorporated by reference, can be used as the uncoated substrate. These uncoated fabrics would be similar to commercially available fabrics from Cerex Advanced Fabrics, Inc. under the trade name CEREX®.

The uncoated fabrics can then be treated and coated with a silicone coating, such as CRX-150, as described in the previous examples. Similar properties would be expected for the coated fabrics except that these fabrics would be expected to be stiffer than the thermally bonded fabrics. These fabrics would not have a bond pattern on them and would have a smooth surface.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

We claim:

1. A coated fabric with a denier per filament of 3.5 or less that:

has a reduced air permeability that is no lower than 25% of the air permeability compared to the uncoated fabric of the uncoated fabric;

passes the SATRA TM 31: Method A: 2003 Martindale Abrasion test for 51,200 dry revolutions and 12,800 wet revolutions; and has a water vapor transmission above 250 g/day-m$^2$.

2. The fabric, according to claim 1, with a stiffness level below 2 Lb$_f$.

3. The fabric, according to claim 1, wherein the coating comprises silicone.

4. The fabric, according to claim 1, where the uncoated fabric is a nonwoven fabric wherein the filaments are made from polyesters, polyamides, polyimides, polypropylene, polyethylene, polystyrene, TEFLON®, fiberglass, polybutylene terephthalate, polytrimethylene, polylactic acid, polycarbonates, polyester terephthalate polybutylene terephthalate, acrylic, or polyvinyl alcohol polymers or a combination of these polymers.

5. The fabric, according to claim 4, where the nonwoven fabric is a spunbonded fabric.

6. The fabric, according to claim 5, where the spunbonded fabric is a nylon nonwoven fabric.

7. The fabric, according to claim 6, where the nylon fabric is made from nylon 6; nylon 6,6; nylon 11; nylon 12; or a combination or copolymer of these nylons.

8. The fabric, according to claim 5, where the spunbonded fabric is a polyester nonwoven fabric.

9. The fabric, according to claim 1, where the uncoated fabric is made of multicomponent fibers made from at least two polymers from polyesters, polyamides, polyimides, polypropylene, polyethylene, polystyrene, TEFLON®, fiberglass, polybutylene terephthalate, polytrimethylene, polylactic acid, polycarbonates, polyester terephthalate polybutylene terephthalate, acrylic, or polyvinyl alcohol polymers or a combination of these polymers.

10. The fabric, according to claim 1, where the denier per filament is two or less.

11. The fabric, according to claim 1, where the uncoated fabric has been printed.

12. The fabric, according to claim 1, where a metallic coating has been applied to the uncoated fabric prior to applying the silicon coating.

13. The fabric, according to claim 6, where the nylon spunbonded fabric is thermally bonded.

14. The fabric, according to claim 6, wherein the nylon spunbonded fabric is autogenously bonded and has a smooth surface without a bond pattern.

15. The fabric, according to claim 1, further comprising at least one of the group selected from antimicrobial, fungicides, and fire retardants.

16. A fabric comprising a plurality of filaments, wherein the fabric has a denier per filament of about 3.5 or less, and wherein the fabric is coated with a coating that comprises silicone.

17. The fabric, according to claim 16, wherein the fabric passes the SATRA TM 31: Method A: 2003 Martindale Abrasion test for 51,200 dry revolutions and 12,800 wet revolutions.

18. The fabric, according to claim 16, wherein the fabric has a water vapor transmission of at least about 250 g/day-$m^2$.

19. The fabric, according to claim 16, wherein the stiffness level of the fabric is about 2 $Lb_f$ or less.

20. The fabric, according to claim 16, wherein the fabric is further coated with a metallic coating.

21. The fabric, according to claim 16, wherein the fabric is a spunbonded nonwoven nylon fabric.

22. The fabric, according to claim 16, wherein the fabric is a nonwoven fabric, and wherein the filaments comprise polyesters, polyamides, polyimides, polypropylene, polyethylene, polystyrene, TEFLON®, fiberglass, polytrimethylene, polylactic acid, polycarbonates, polyester terephthalate, polybutylene terephthalate, acrylic, polyvinyl alcohol polymers, or blends or copolymers thereof.

23. The fabric, according to claim 22, wherein the filaments comprise polyethylene, and wherein the polyethylene has a melt index between about 5 grams/10 minutes and about 200 grams/10 minutes, and wherein the polyethylene has a density between about 0.85 grams/cc and about 1.1 grams/cc, and wherein the concentration of the polyethylene is between about 0.05% and about 20%.

* * * * *